US008863826B2

(12) United States Patent
Mao et al.

(10) Patent No.: US 8,863,826 B2
(45) Date of Patent: Oct. 21, 2014

(54) TOP-MOUNTED DIGITAL-CONTROL TOWER PUMPING UNIT

(75) Inventors: Hongwei Mao, Beijing (CN); Bo Liu, Beijing (CN)

(73) Assignee: International Business Alliance Management, Inc., Sherman Oaks, CA (US)

( * ) Notice: Subject to any disclaimer, the term of this patent is extended or adjusted under 35 U.S.C. 154(b) by 570 days.

(21) Appl. No.: 13/132,898

(22) PCT Filed: Jun. 10, 2009

(86) PCT No.: PCT/CN2009/072200

§ 371 (c)(1),
(2), (4) Date: Jun. 3, 2011

(87) PCT Pub. No.: WO2010/063171

PCT Pub. Date: Jun. 10, 2010

(65) Prior Publication Data

US 2011/0250081 A1 Oct. 13, 2011

(30) Foreign Application Priority Data

Dec. 3, 2008 (CN) ..... 2008 1 0238864
May 21, 2009 (CN) ..... 2009 1 0084561

(51) Int. Cl.
*E21B 43/00* (2006.01)
*F04B 47/02* (2006.01)
*E21B 43/12* (2006.01)

(52) U.S. Cl.
CPC ..... *F04B 47/02* (2013.01); *E21B 43/126* (2013.01)
USPC ..... 166/67; 166/369; 166/379; 166/65.1; 166/66.4; 166/75.11

(58) Field of Classification Search
USPC ..... 166/369, 379, 380, 65.1, 66.4, 67, 68, 166/105
See application file for complete search history.

(56) References Cited

U.S. PATENT DOCUMENTS

| | | | | | |
|---|---|---|---|---|---|
| 1,708,584 | A | * | 4/1929 | Mason | 91/350 |
| 2,681,623 | A | * | 6/1954 | Kane | 417/399 |
| 3,345,950 | A | * | 10/1967 | Bender | 318/14 |
| 3,782,117 | A | * | 1/1974 | James | 60/372 |
| 3,989,993 | A | * | 11/1976 | Ewing | 318/282 |
| 4,073,341 | A | * | 2/1978 | Parker | 166/66.4 |
| 4,161,137 | A | * | 7/1979 | Gaddy | 92/13 |
| 4,314,400 | A | * | 2/1982 | Davis | 29/426.4 |
| 4,456,060 | A | * | 6/1984 | Stanton | 166/68.5 |
| 4,512,149 | A | * | 4/1985 | Weaver | 60/371 |
| 4,698,968 | A | * | 10/1987 | Mestieri | 60/372 |

(Continued)

*Primary Examiner* — Shane Bomar
*Assistant Examiner* — Elizabeth Gitlin
(74) *Attorney, Agent, or Firm* — Kelly & Kelley, LLP

(57) ABSTRACT

A top-mounted digital-control tower pumping unit includes a tower frame (1), a power system (2), a drive system, a control system (3), a balance weight box (4), a balance weight positioning cable (5), a driving cable (6), a plurality of cable hangers (7) and a guide wheel mechanism. The guide wheel mechanism is fixed on an operation platform by a rotating shaft, which is convenient for the operator to move the guide wheel mechanism aside during the oil well work-over. The control system, the power system, and the drive system are all mounted closely on an operating platform on the top of the tower frame. The top-mounted digital-control tower pumping unit of the present invention has the advantages of simple structure, convenient maintenance, low cost, stable operation and small noise.

20 Claims, 7 Drawing Sheets

(56) References Cited

U.S. PATENT DOCUMENTS

| | | | | |
|---|---|---|---|---|
| 4,719,811 | A * | 1/1988 | Lang et al. | 74/89.22 |
| 4,890,671 | A * | 1/1990 | Baxter | 166/250.01 |
| 5,375,657 | A * | 12/1994 | Shi et al. | 166/68.5 |
| 6,749,017 | B1 * | 6/2004 | Lu et al. | 166/53 |
| 7,001,157 | B2 * | 2/2006 | Xiaoxi | 417/415 |
| 7,635,022 | B2 * | 12/2009 | Han et al. | 166/65.1 |
| 7,891,237 | B2 * | 2/2011 | Mills | 73/152.61 |
| 8,047,821 | B2 * | 11/2011 | Gu et al. | 417/555.2 |
| 2004/0131484 | A1 * | 7/2004 | Xiaoxi | 417/416 |
| 2006/0024171 | A1 * | 2/2006 | Smith et al. | 417/199.1 |
| 2006/0024177 | A1 * | 2/2006 | Robison et al. | 417/390 |
| 2006/0233650 | A1 * | 10/2006 | Zhou | 417/416 |
| 2007/0020110 | A1 * | 1/2007 | Mills | 417/53 |
| 2007/0110598 | A1 * | 5/2007 | Jacobs et al. | 417/397 |
| 2012/0138312 | A1 * | 6/2012 | Strong | 166/377 |
| 2013/0058803 | A1 * | 3/2013 | Mao | 417/313 |
| 2013/0112021 | A1 * | 5/2013 | Mao | 74/89.22 |

* cited by examiner

TOP-MOUNTED DIGITAL-CONTROL TOWER PUMPING UNIT

BACKGROUND OF THE PRESENT INVENTION

1. Field of Invention

The present invention relates to a petroleum extraction machinery equipment, and more particularly to a top-mounted digital-control tower pumping unit.

2. Description of Related Arts

Currently, various petroleum extraction machinery equipments are used in the petroleum production. Among those the beam pumping unit is the most mature one although it is being gradually replaced by the tower type pumping unit due to the disadvantages of its gigantic and heavy structure, high energy consumption, low efficiency, and inconvenient maintenance and adjustment. The existing tower pumping units mostly employ the reducer box to decelerate in which the motor is connected with the reducer via the coupling. The large gear, the head sheave and the hoisting wheel are fastened together and are seated on the head sheave shaft via the bearing. The head sheave is clamped tightly by the head sheave fastening device. During the oil pumping, the motor drives the reducer box through the coupling, the small gear connected with the output shaft of the reducer box is engaged with the large gear, so that the head sheave fastened to the large gear regularly rotates in the forward and backward directions, thereby driving the polish rod to move upwards and downwards. In these tower pumping units, the transmission gear mechanism of the reducer box is difficult and expensive to produce. Furthermore, the big noise is caused by the gear meshing during operation, and the frequent maintenances are needed due to the always occurred oil leakage. Also, there exists a pumping unit using the direct motor drive without reducer box. This kind of pumping unit overcomes the disadvantages of the reducer box with a one stage belt type speed reduction or without the reducer box. However, the direct motor drive mechanism increases the cost about 5 to 10 times compared with the beam pumping unit. Simultaneously, using the one-stage belt type speed reduction results in the disadvantages of deficient power and short life of the belt. Therefore, it is necessary to develop a new pumping unit to overcome the shortcomings mentioned above.

SUMMARY OF THE PRESENT INVENTION

An object of the present invention is to provide a top-mounted digital-controlled tower pumping unit (TMDCTPU), which has simpler structure, lower cost, more stable operational property, and wider applications.

The TMDCTPU of the present invention comprises a tower frame, a power system, a drive system, a control system, a balance weight box, a balance weight positioning cable, a cable wheel, a driving cable, and a plurality of cable hangers. The power system, the drive system, the control system and the cable wheel are installed on the operating platform at the top of the tower frame. The control system is connected with the power system to control the reversing position and rotating speed of the power system which connects to the cable wheel via the drive system. The TMDCTPU also comprises a guide wheel mechanism comprising a guide wheel support, a guide bar, a rotating shaft, a guide wheel fixture, and a guide wheel. The guide wheel support is fastened at a side of the operating platform near the cable wheel with the adjustable bolts, one end of the guide bar is installed on the guide wheel support with the removable bolts, the rotating shaft passes through the junction of the guide bar and the guide wheel support, one end of the rotating shaft is fastened within the guide bar and the other end of the rotating shaft is installed within the guide wheel support via the bearings C, the guide wheel fixture is installed at the free end of the guide bar, the guide wheel is installed on the guide wheel fixture. The cable wheel has several sets of fastening holes, and one end of the balance positioning cable is fastened to one set of fastening holes while one end of the driving cable is fastened to another set of fastening holes. The balance weight positioning cable and the driving cable are wrapped around the cable wheel in the opposite direction to each other. The free end of the balance weight positioning cable is connected with the balance weight box via the cable hanger D. The free end of the driving cable is wrapped over the guide wheel and connected with the polish rod via the cable hanger E.

In the TMDCTPU of the present invention, the drive system comprises a transmission belt, a small pulley sprocket wheel, a large pulley sprocket wheel, a transmission shaft, a small gear, a large gear, and a cable wheel shaft. The small pulley sprocket wheel is fastened at the output end of the power system, and drives the large pulley sprocket wheel through the transmission belt. The large pulley sprocket wheel is fastened at one end of the transmission shaft, the small gear is fastened at the other end of the transmission shaft, the transmission shaft is seated on the transmission shaft support by a pair of bearings A, the small gear is engaged with the large gear, the large gear is fastened on the cable wheel through the pins, the cable wheel shaft is installed inside of the cable wheel through a pair of bearings B, two ends of the cable wheel shaft are respectively fastened on the shaft seats, the shaft seats are fastened on the operating platform.

In the TMDCTPU of the present invention, a plurality of sprockets F are provided at the inner side of the small pulley sprocket wheel, a plurality of sprockets G are provided at the inner side of the large pulley sprocket wheel, and a driving chain is installed on the sprockets F and G.

In the TMDCTPU of the present invention, the drive system comprises a sprocket wheel J, a sprocket wheel K, a transmission shaft, a small gear, a ring gear and a cable wheel shaft. The sprocket wheel J is installed at the output end of the power system and drives the sprocket wheel K via the chain. The sprocket wheel K is installed at one end of the transmission shaft and the small gear is installed at the other end of the transmission shaft. The transmission shaft is installed on the transmission shaft support via a pair of bearings H. The ring gear is installed at the outside middle position of the cable wheel. The cable wheel is installed on the cable wheel shaft via a pair of bearings I. Two sides of the cable wheel shaft are respectively fastened on the shaft seats. The shaft seats are fastened on the operating platform. The small gear is engaged with the ring gear.

In the TMDCTPU of the present invention, each of the sprocket wheels J and K uses two sets of sprocket wheels. The sprocket wheel J consists of two sets of sprocket wheels with the same size. The sprocket wheel K consists of two sets of sprocket wheels with the different sizes, wherein the diameter of the large sprocket wheel is 2 or 3 times that of the small sprocket wheel.

In the TMDCTPU of the present invention, the drive system comprises a sprocket wheel L, a sprocket wheel M and a cable wheel shaft. The sprocket wheel L is fastened at the output end of the power system, and drives the sprocket wheel M via the chain, the sprocket wheel M is fastened at the outside middle position of the cable wheel, the cable wheel is installed on the cable wheel shaft through a pair of bearings N, two ends of the cable wheel shaft are respectively fastened on the shaft seats. The shaft seats are fastened on the operating platform.

In the TMDCTPU of the present invention, each of the sprocket wheels L and M uses two sets of sprocket wheels. The sprocket wheel L consists of two sets of sprocket wheels with the same size. The sprocket wheel M consists of two sets of sprocket wheels with the different sizes, wherein the diameter of the large sprocket wheel is 1.5 times that of the small sprocket wheel.

In the TMDCTPU of the present invention, two sets of guide wheel mechanisms are installed on the operating platform, two ends of the cable wheel are respectively wrapped around two driving cables, one end of each of the driving cables is fastened to the cable wheel, the other end thereof is wrapped over the related guide wheel and connected with the cable hanger E'.

In the TMDCTPU of the present invention, the balance weight box comprises a main weight box and a multi-level secondary weight block. The secondary weight block is hung on the main weight box via the hooks installed at two sides of the main weight box. The main weight box and the multi-level secondary balance weight block are filled with concrete, sand, and steel, the total weight of the multi-level secondary balance weight block is less than 10% of the total weight of the main weight box.

In the TMDCTPU of the present invention, the pull bars are respectively installed on the operating platform at two sides of the guide wheel support. The fixed pulleys are respectively installed on the upper ends of the pull bars. A pair of pull hooks are provided at two sides of the guide wheel fixture, the steel cables are respectively fastened on the pull hooks, the other end of each of the steel cables is fastened on the operating platform after wrapping over the related fixed pulley.

In the TMDCTPU of the present invention, the power system is a permanent magnet synchronized braking motor.

In the TMDCTPU of the present invention, the control system is installed inside the permanent magnet synchronized braking motor.

Compared with the prior art, no gear reducer box exists in the drive system of the TMDCTPU of the present invention. By several simple transmission types, the TMDCTPU of the present invention has the simpler structure, lower cost, more stable operation and smaller noise. The guide wheel of the TMDCTPU of the present invention is fastened on the operating platform by a rotating shaft, which is convenient for the operator to move the guide wheel aside during the oil well work-over.

In the drive system of the TMDCTPU of the present invention, the power is firstly transferred to the transmission shaft by the first stage speed reduction with the belt, chain, or a combination of chain and belt. Undergo the second stage speed reduction through a pair of gears, the oil pumping is accomplished by the up and down movements of the polish rod and the balance weight box driven by the driving cable and the balance weight positioning cable that are wrapped around and fastened onto the cable wheel. The advantages of the first stage speed reduction using chain, or a combination of chain and belt includes reducing the power loss, maintaining high working efficiency under large load, and reducing noise when operating in the environmentally sensitive area. In the TMDCTPU of the present invention, the ring gear or sprocket wheel which drives the cable wheel is fastened to the middle of the cable wheel. This mechanism produces a balanced loading on the cable wheel shaft and two sets of driving cables wrapped at two ends of the cable wheel during operation, requires more compact space for all equipments on the operating platform, and makes a more stable center of gravity. At the meantime, replacing the regular gear with the ring gear also reduces the footage requirement of the operating platform, thus reducing the overall cost of the complete pumping unit. In the TMDCTPU of the present invention, the drive mechanism can either be a two-stage combination power transfer consists of a transmission shaft, sprockets, and gears or be a single-stage power transfer with direct chain drive of the sprocket wheel on the cable wheel. The load capacity of the TMTDCPU with two-stage combination power transfer is greater than that of the TMTDCPU with single-stage power transfer, thus enabling the proper selection of the pumping unit model in accordance with the actual oil well production requirement. In the TMDCTPU of the present invention, there can be two sets of sprocket wheels, different diameters of the sprocket wheels can be selected for each sprocket set, thus different power transfer ratios can be realized from the pairing of different sized sprockets to meet not only the need to carry the large weight during unloading the polish rod with smaller rated motor, but also the requirements of the optimum stroke length and frequency during oil pumping. The balance weight box of the TMDCTPU of the present invention adopts the main weight box and the multi-level weight blocks to adjust the balance weight, thus a high efficiency low energy consumption oil pumping state can be achieved by adjusting the balance weight for the power system according to the changes of the quantity of oil pumping.

In a summary of above, compared with the prior art, the TMDCTPU of the present invention has some advantages as below. It has simpler structure, lower cost, less system trouble spot, easy maintenance, high power transfer efficiency, low energy consumption and is suitable for all oil production conditions. In addition, due to the characteristic of easy maintenance, it is possible to place the power system, the drive system, and the control system on the top of the tower frame, thus having excellent properties in flood, dust and theft prevention.

The TMDCTPU of the present invention is further explained in detail with the accompanying drawings.

DETAILED DESCRIPTION OF THE PREFERRED EMBODIMENT

Figure 1:
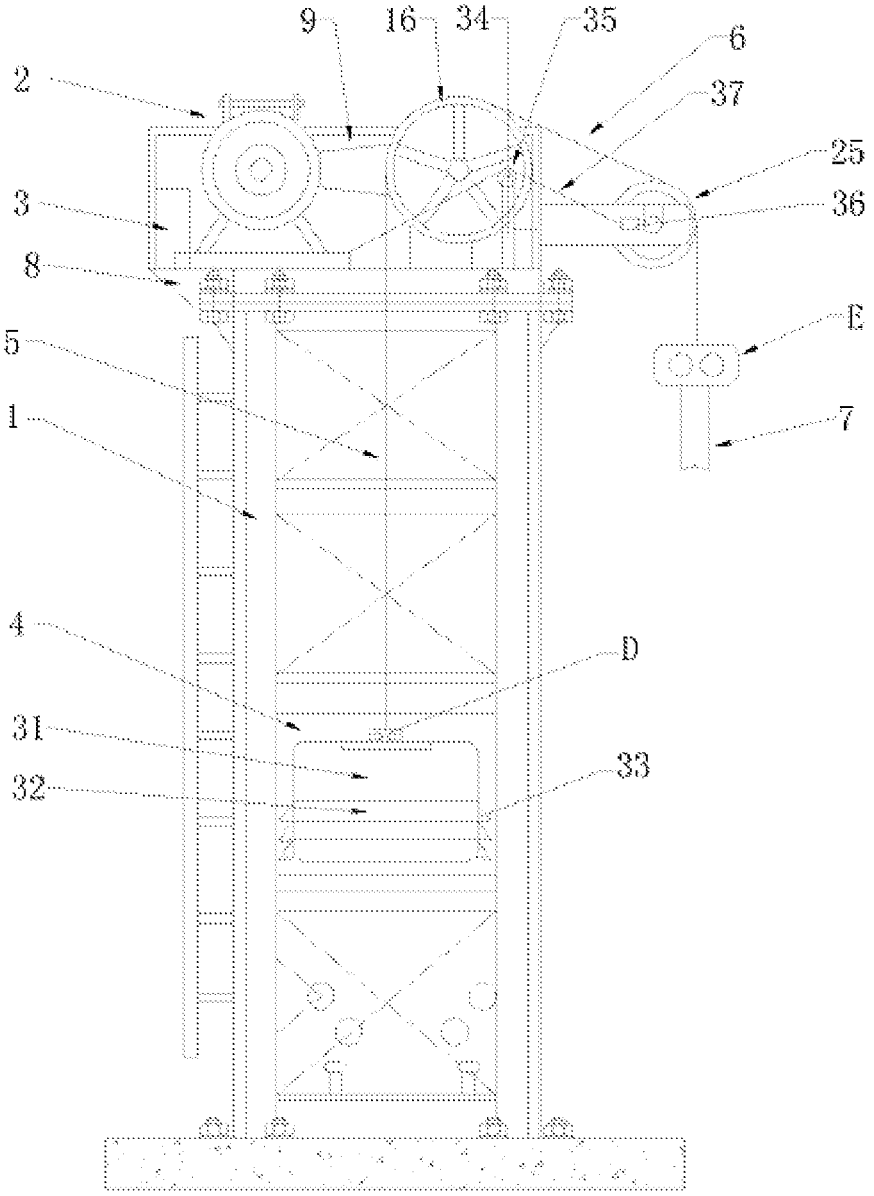
FIG. 1 is a front view of a top-mounted digital-control tower pumping unit according to a first preferred embodiment of the present invention.

Referring to FIG. 1 of the drawings, a top-mounted digital-control tower pumping unit (TMDCTPU) according to a first preferred embodiment of the present invention is illustrated, wherein the TMDCTPU comprises a tower frame 1, a power system 2, a drive system, a control system 3, a balance weight box 4, a balance weight positioning cable 5, a driving cable 6, and cable hangers. The power system 2, the drive system, and the control system 3 are installed on the operating platform 8 which is located at the top of the tower frame 1. Operator controls the working of the TMDCTPU on the ground near the tower frame 1 via either the wireless or wired control device of the control system 3. The balance weight box 4 comprises a main weight box 31 and a multi-level secondary weight block 32. The multi-level secondary weight block 32 is hung on the main weight box 31 via the hooks 33 which are installed at two sides of the main weight box 31. The main weight box 31 and the multi-level secondary balance weight block 32 are filled with concrete, sand, and steel, the total weight of the multi-level secondary balance weight block is less than 10% of the total weight of the main weight box. The operator can adjust the weight of the balance weight box 4 in accordance with the actual load of the polish rod 7 to reach a relative balanced working condition between the polish rod 7 and the balance weight, thus lowering the energy consumption of the power system 2 and the drive system.

Figure 2:
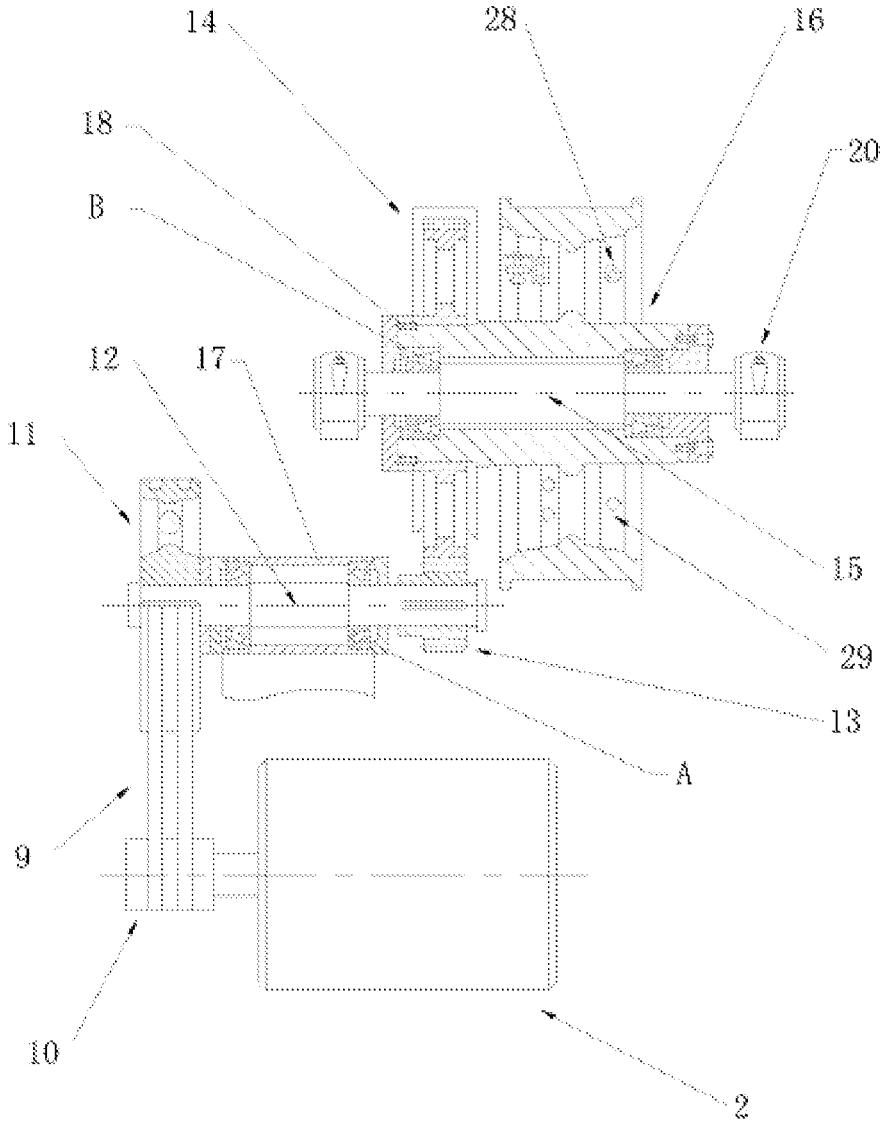
FIG. 2 is a structural diagram of a drive system of the top-mounted digital-control tower pumping unit according to the first preferred embodiment of the present invention.
Figure 4:
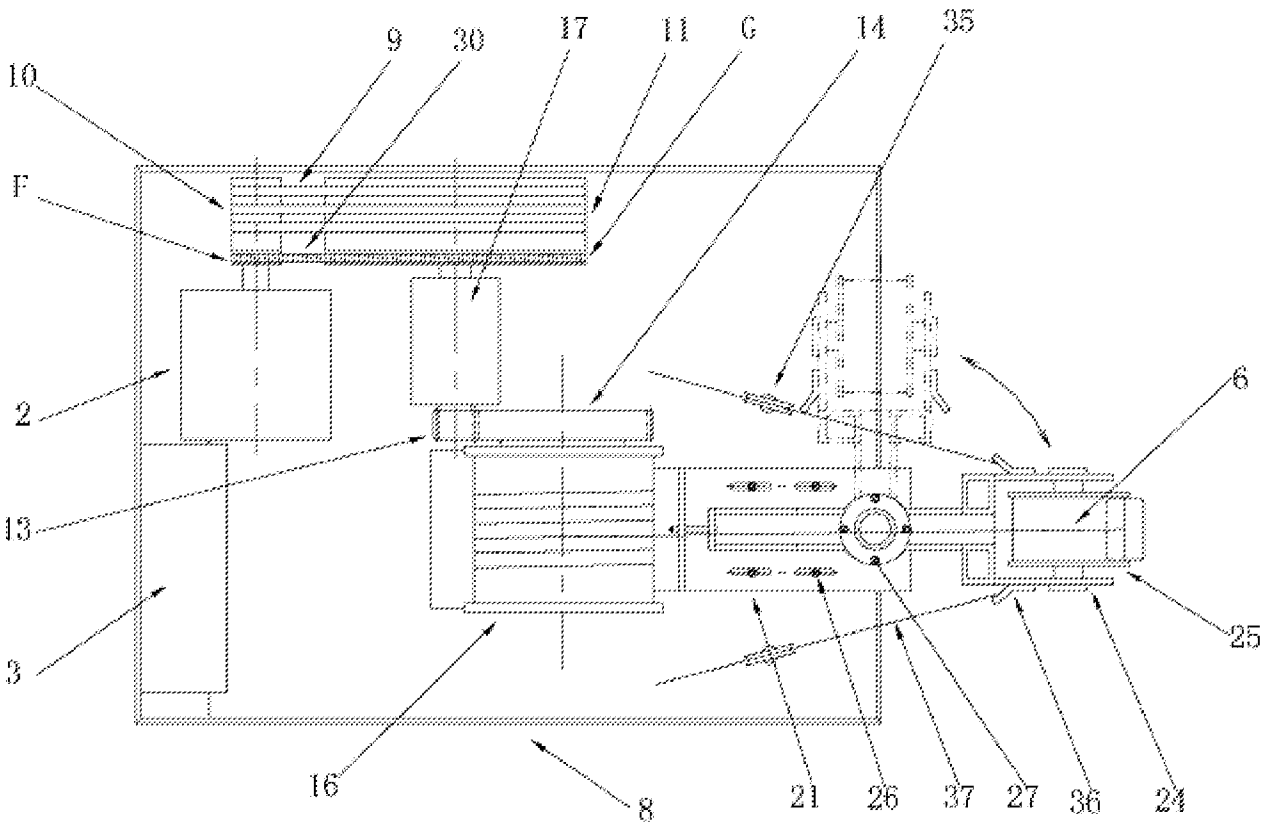
FIG. 4 is a top view of the top-mounted digital-control tower pumping unit according to the first preferred embodiment of the present invention.

As shown in FIGS. 2 and 4, the drive system comprises a transmission belt 9, a small pulley sprocket wheel 10, a large pulley sprocket wheel 11, a transmission shaft 12, a small gear 13, a large gear 14, and a cable wheel shaft 15. The small pulley sprocket wheel 10 is installed at the output end of the power system 2, and drives the large pulley sprocket wheel 11 through the transmission belt 9. A plurality of sprockets F are provided at the inner side of the small pulley sprocket wheel 10, a plurality of sprockets G are provided at the inner side of the large pulley sprocket wheel 11, and a driving chain 30 is installed on the sprockets F and G. The belt can be selected to transfer power under smaller work load or in the noise sensitive area, the chain or combination of belt and chain can be used under larger work load, the chain transmission guarantees the non-slippage during the unloading of the polish rod. The large pulley sprocket wheel 11 is fastened at one end of the transmission shaft 12, the small gear 13 is fastened at the other end of the transmission shaft 12, the transmission shaft 12 is seated on the transmission shaft support 17 by a pair of bearings A, the small gear 13 is engaged with the large gear 14, the large gear 14 is fastened on the cable wheel 16 through the pins 18, the cable wheel shaft 15 is installed in the interior of the cable wheel 16 through a pair of bearings B, two ends of the cable wheel shaft 15 are respectively fastened on the shaft seats 20 which are fastened on the operating platform 8.

Figure 3:
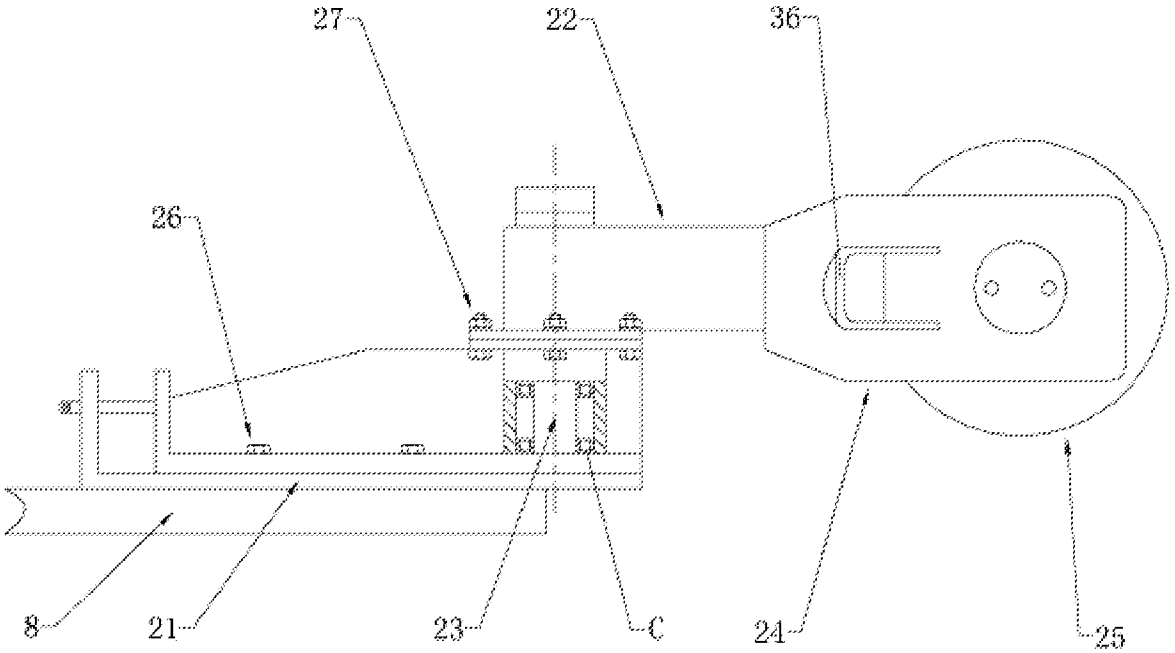
FIG. 3 is a structural diagram of a guide wheel mechanism of the top-mounted digital-control tower pumping unit.

As shown in FIGS. 3 and 4, the TMDCTPU further comprises a guide wheel mechanism. The guide wheel mechanism comprises a guide wheel support 21, a guide bar 22, a rotating shaft 23, a guide wheel fixture 24, and a guide wheel 25. The guide wheel support 21 is fastened on a side of the operating platform 8 near the cable wheel 16 with the adjustable bolts 26. One end of the guide bar 22 is installed on the guide wheel support 21 through the removable bolts 27. The operator can change the position of extension of the guide bar 22 from the tower frame 1 by changing the position of the adjustable bolts 26, such that the center of the polish rod aims at that of the well head. The rotating shaft 23 passes through the junction of the guide bar 22 and the guide wheel support 21, one end of the rotating shaft 23 is fastened inside the guide bar 22 and the other end of the rotating shaft 23 is installed inside the guide wheel support 21 through the bearings C. The guide wheel fixture 24 is installed at the free end of the guide bar 22, and the guide wheel 25 is installed on the guide wheel fixture 24. During the well work-over, the polish rod 7 is untied from the driving cable 6, then the guide wheel 25 is swung away from the well head, the operator only needs to loosen the removable bolts 27, then the guide bar 22 can rotate about the center of the rotating shaft 23 to move the guide wheel 25 to two sides away from the center of the well.

As shown in FIGS. 1, 2 and 4, there are two sets of fastening holes 28, 29 on the cable wheel 16, one end of the balance weight positioning cable 5 is fastened to the fastening holes 28, one end of the driving cable 6 is fastened to the fastening holes 29, the balance weight positioning cable 5 and driving cable 6 are wrapped around the cable wheel 16 in the opposite direction to each other. The free end of the balance weight positioning cable 5 is connected with the balance weight box 4 through the cable hanger D, the free end of the driving cable 6 is connected with the polish rod 7 through the cable hanger E after wrapping around the guide wheel 25. The pull bars 34 are installed on the operating platform 8 at two sides of the guide wheel support 21. The fixed pulleys 35 are respectively installed on the upper ends of the pull bars 34. A pair of pull hooks 36 are respectively provided on both sides of the guide wheel fixture 24, two steel cables 37 are respectively fastened on the pull hooks 36, the other end of each of the steel cables 37 is fastened on the operating platform 8 after wrapping about the corresponding fixed pulley 35. The steel cables 37 can pull the guide bar 22 to prevent the distortion of the guide bar 22 under larger load and vibration.

The operating procedure of the TMDCTPU of the present invention is briefly described as below. The operator operates the control system 3 using the wireless or wired remote control device on the ground near the tower frame 1, the control system 3 drives the power system 2 to regularly rotate forward and backward in turn and regulates the rotating speed of the power system 2. The small pulley sprocket wheel 10 drives the large pulley sprocket wheel 11, so that the small gear 13 coaxial to the large pulley sprocket wheel 11 is driven, the small gear 13 drives the large gear 14 engaged therewith and simultaneously drives the cable wheel 16 to regularly rotate forward and backward in turn, thus the upward and downward movements of the polish rod 7 and the balance weight box 4 are achieved. When the polish rod 7 moves downward, the balance weight box 4 moves upward to store the potential energy; when the polish rod 7 moves upward, the balance weight box 4 moves downward to release the potential energy, thus greatly reducing the energy consumption of the oil extraction.

Figure 5:
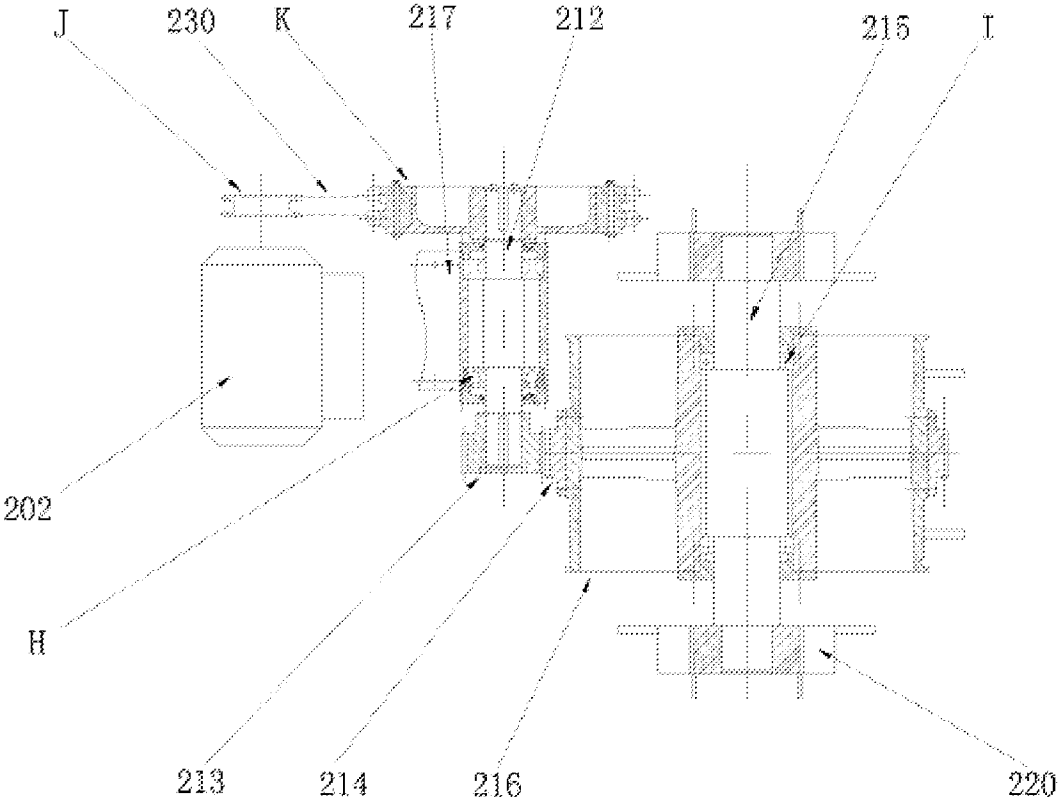
FIG. 5 is a structural diagram of the drive system of the top-mounted digital-control tower pumping unit according to a second preferred embodiment of the present invention.
Figure 6:
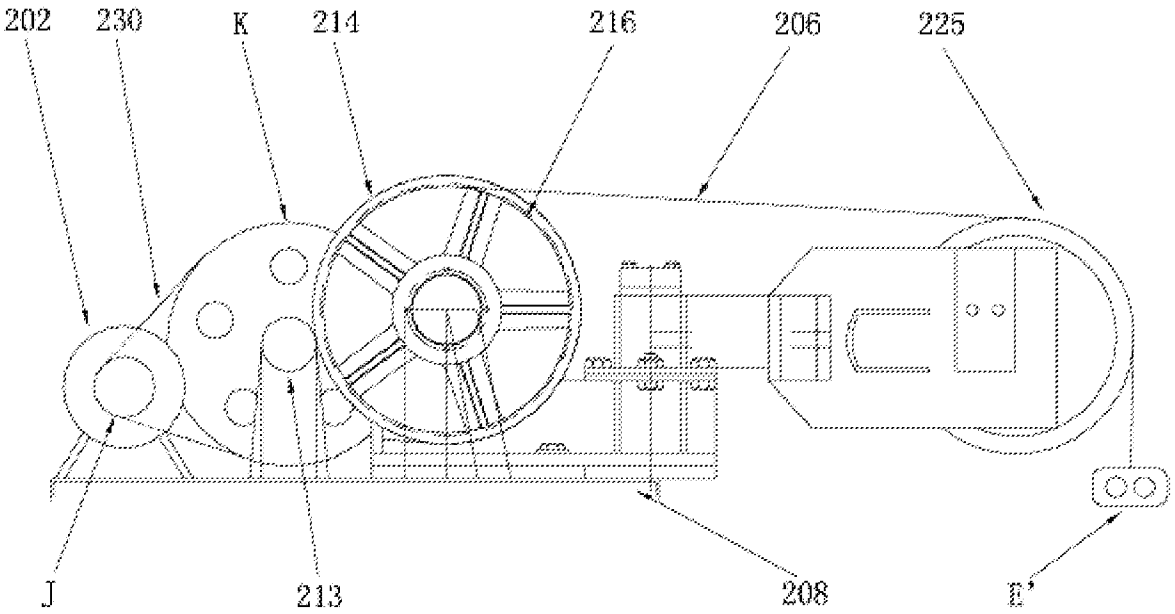
FIG. 6 is a front view of the drive system and guide wheel mechanism of the top-mounted digital-control tower pumping unit according to the second preferred embodiment of the present invention.

Referring to FIGS. 5 and 6 of the drawings, a top-mounted digital-control tower pumping unit (TMDCTPU) according to a second preferred embodiment of the present invention is illustrated. It is different from the first embodiment of the present invention as follows. It uses the sprocket wheels J and k to replace the small pulley sprocket wheel 10 and the large pulley sprocket wheel 11. It uses the ring gear 214 to replace the large gear 14. The sprocket wheel J is installed at the output end of the power system 202 and drives the sprocket wheel K via the chain 230. The sprocket wheel K is installed at one end of the transmission shaft 212 and the small gear 213 is installed at the other end of the transmission shaft 212. The transmission shaft 212 is installed on the transmission shaft support 217 via a pair of bearings H. The ring gear 214 is installed at the outside middle position of the cable wheel 216. The cable wheel 216 is placed on the cable wheel shaft 215 via a pair of bearings I. Two sides of the cable wheel shaft 215 are respectively fastened on the shaft seats 220. The shaft seats 220 are fastened on the operating platform 208. The small gear 213 is engaged with the ring gear 214. Two sets of guide wheel mechanisms are installed on the operating platform 208, two ends of the cable wheel 216 are wrapped respectively two sets of driving cables 206, one end of each of the driving cables 206 is fastened to the cable wheel 216, the other end thereof is wrapped over the related guide wheel 225 and connected with the cable hanger E'.

Figure 7:
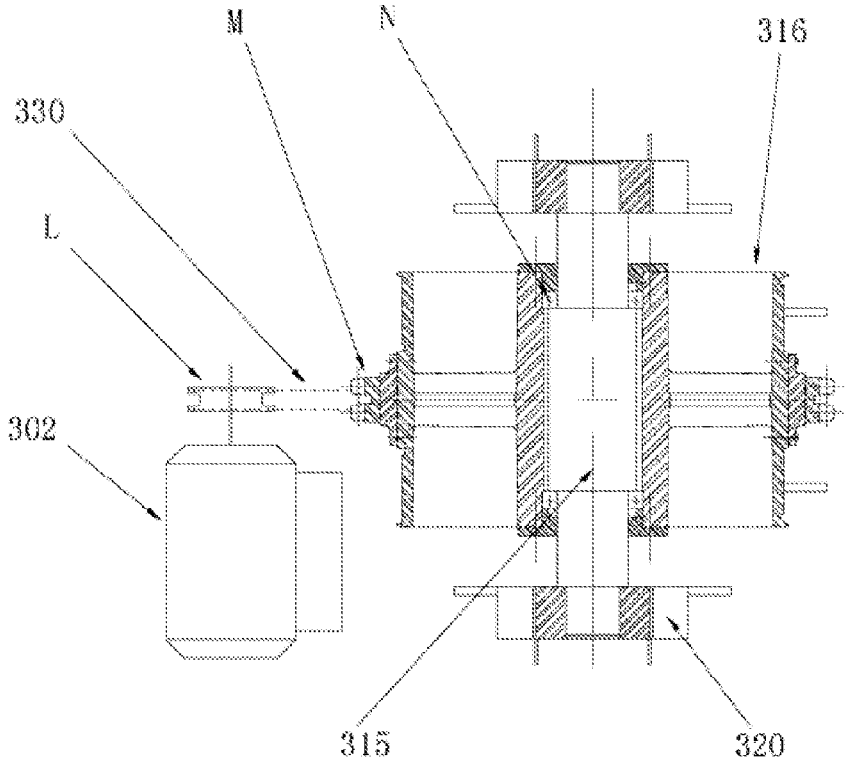
FIG. 7 is a structural diagram of the drive system of the top-mounted digital-control tower pumping unit according to a third preferred embodiment of the present invention.

Referring to FIG. 7 of the drawings, a top-mounted digital-control tower pumping unit (TMDCTPU) according to a third preferred embodiment of the present invention is illustrated. It is different from the second embodiment of the present invention as follows. The sprocket wheel M is used to replace the ring gear 214, the sprocket wheel L is installed at the output end of the power system 302 and drives the sprocket wheel M via the chain 330, the sprocket wheel M is installed on the outside middle position of the cable wheel 316, the cable wheel 316 is installed on the cable wheel shaft 315 through a pair of bearings N, two ends of the cable wheel shaft 315 are respectively fastened on the shaft seats 320.

Figure 8:
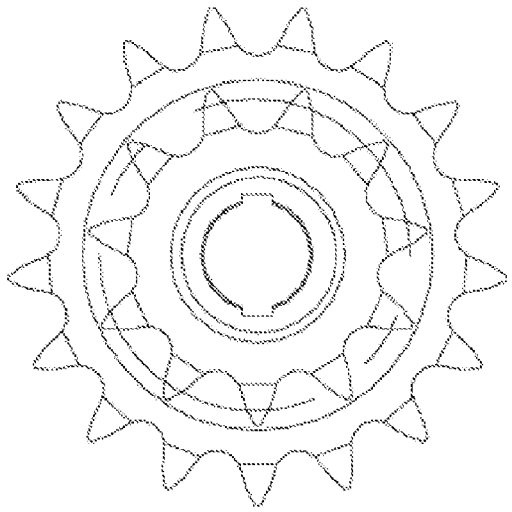
FIG. 8 is a structural diagram of an alternative mode of the sprocket wheels K and M.

In accordance with the need of actual situations, two sets of sprocket wheels shown in FIG. 8 can be selected for the sprocket wheels K, M in the two embodiments mentioned above. Each of the two sets of sprocket wheels has a large sprocket wheel and a small sprocket wheel, wherein the diameter of the large sprocket wheel of the set of sprocket wheels K is 2 or 3 times that of small sprocket wheel of the set of sprocket wheels K, while the diameter ratio between the large sprocket and the small sprocket of the set of sprockets M is 1.5, thus the power transfer ratio of the power transfer mechanism can be adjusted by connecting the chain to the sprocket wheels with different sizes.

The power system of the TMDCTPU of the present invention utilize the permanent magnet synchronized braking motor, and the control system can be installed inside this permanent magnet synchronized braking motor.

The embodiments described above are merely the optimum embodiments for the present invention, and should not be construed as limiting the scope of this invention. Without deviating from the spirit of this invention, any changes or improvements in form or technical plan of this invention by common technicians in this technology area shall all fall under the scope of protections as defined in claims of this invention.

INDUSTRIAL APPLICABILITY

The TMDCTPU of the present invention provides some advantages of simple structure, low cost, stable operating property, low energy consumption, and high efficiency. It has potential to replace the traditional beam pumping unit to become one of the main models for the oil extracting equipments, thereby possessing a great market potential and strong industrial applicability.

What is claimed is:

1. A top-mounted digital-control tower pumping unit, comprising a tower frame having an operating platform, a power system, a drive system, a control system, a cable wheel, and a guide wheel mechanism, wherein said power system, said drive system, said control system and said cable wheel are installed on said operating platform at a top of said tower frame, said control system is connected with said power system so as to control a reversing position and rotating speed of said power system, said power system is connected with said cable wheel via said drive system;

wherein said guide wheel mechanism comprises a guide wheel support fastened at a side of said operating platform near said cable wheel, one end of a guide bar is installed on said guide wheel support, a rotating shaft passes through a junction of said guide bar and said guide wheel support with one end of said rotating shaft fastened within said guide bar and the other end of said rotating shaft installed within said guide wheel support, a guide wheel fixture is installed at a free end of said guide bar and a guide wheel is installed on said guide wheel fixture;

wherein said cable wheel has first and second set of fastening holes, one end of a balance weight positioning cable is fastened to said first set of fastening holes and one end of a driving cable is fastened to said second set of fastening holes, with said balance weight positioning cable and said driving cable wrapped around said cable wheel in opposite directions to each other a free end of said balance weight positioning cable is connected to a balance weight box by a first cable hanger, and a free end of said driving cable is wrapped over said guide wheel and connected to a polish rod by a second cable hanger;

wherein said drive system comprises a first pulley sprocket wheel fastened at an output end of said power system and driving a second pulley sprocket wheel through a transmission belt, said second pulley sprocket wheel fastened at one end of a transmission shaft and a first gear fastened at another end of said transmission shaft with said transmission shaft seated on a transmission shaft support, said first gear engaged with a second gear that is fastened on said cable wheel, a cable wheel shaft installed inside said cable wheel, two ends of said cable wheel shaft are respectively fastened on two shaft seats, said two shaft seats fastened on said operating platform.

2. The top-mounted digital-control tower pumping unit, as recited in claim 1, wherein a plurality of first sprockets are provided at an inner side of said first pulley sprocket wheel and a plurality of second sprockets are provided at an inner side of said second pulley sprocket wheel, wherein said drive system further comprises a driving chain installed on said pluralities of first and second sprockets.

3. The top-mounted digital-control tower pumping unit, as recited in claim 1, wherein said balance weight box comprises a main weight box, a multi-level secondary weight block and a plurality of hooks, said secondary weight block is hung on said main weight box via said hooks installed at two sides of said main weight box, said main weight box and said multi-level secondary balance weight block are filled with concrete, sand and steel, a total weight of said multilevel secondary balance weight block is less than 10% of a total weight of said main weight box.

4. The top-mounted digital-control tower pumping unit, as recited in claim 1, further comprising two pull bars respectively installed on said operating platform at two sides of said guide wheel support, two fixed pulleys respectively installed on two upper ends of said pull bars, a pair of pull hooks respectively provided at two sides of said guide wheel fixture, and two steel cables respectively fastened on said pull hooks, wherein the other end of each of said steel cables is fastened on said operating platform after wrapping over a related fixed pulley.

5. The top-mounted digital-control tower pumping unit, as recited in claim 1, wherein said power system is a permanent magnet synchronized braking motor.

6. The top-mounted digital-control tower pumping unit, as recited in claim 5, wherein said control system is installed inside said permanent magnet synchronized braking motor.

7. A top-mounted digital-control tower pumping unit, comprising a tower frame having an operating platform, a power system, a drive system, a control system, a cable wheel, and a guide wheel mechanism, wherein said power system, said drive system, said control system and said cable wheel are installed on said operating platform at a top of said tower frame, said control system is connected with said power system so as to control a reversing position and rotating speed of said power system, said power system is connected with said cable wheel via said drive system;

wherein said guide wheel mechanism comprises a guide wheel support fastened at a side of said operating platform near said cable wheel, one end of a guide bar is installed on said guide wheel support, a rotating shaft passes through a junction of said guide bar and said guide wheel support with one end of said rotating shaft fastened within said guide bar and the other end of said rotating shaft installed within said guide wheel support, a guide wheel fixture is installed at a free end of said guide bar and a guide wheel is installed on said guide wheel fixture;

wherein said cable wheel has first and second set of fastening holes, one end of a balance weight positioning cable is fastened to said first set of fastening holes and one end of a driving cable is fastened to said second set of fastening holes, with said balance weight positioning cable and said driving cable wrapped around said cable wheel in opposite directions to each other a free end of said balance weight positioning cable is connected to a balance weight box by a first cable hanger, and a free end of said driving cable is wrapped over said guide wheel and connected to a polish rod by a second cable hanger;

wherein said drive system comprises a first set of sprocket wheels fastened at an output end of said power system and driving a second set of sprocket wheels, said second set of sprocket wheels fastened at one end of a transmission shaft and a gear wheel fastened at another end of said transmission shaft, said transmission shaft installed on a transmission shaft support, a ring gear installed at an outside middle position of said cable wheel, said cable wheel installed on a cable wheel shaft, two ends of said cable wheel shaft respectively fastened on two shaft seats, said shaft seats fastened on said operating platform, and said gear wheel engaged with said ring gear.

8. The top-mounted digital-control tower pumping unit, as recited in claim 7, wherein said first set of sprocket wheels consists of two sprocket wheels with a same size, and said second set of sprocket wheels consists of a first and second sprocket wheels with different sizes, wherein a diameter of said second sprocket wheel of said second set is 2 or 3 times that of said first sprocket wheel of said second set.

9. The top-mounted digital-control tower pumping unit, as recited in claim 8, wherein said top-mounted digital-control tower pumping unit comprises two guide wheel mechanisms installed on said operating platform, two driving cables are respectively wrapped at two ends of said cable wheel, one end of each of said two driving cables is fastened to said cable wheel, the other end thereof is wrapped over a related guide wheel and connected with said second cable hanger.

10. The top-mounted digital-control tower pumping unit, as recited in claim 7, wherein said top-mounted digital-control tower pumping unit comprises two guide wheel mechanisms installed on said operating platform, two driving cables are respectively wrapped at two ends of said cable wheel, one end of each of said two driving cables is fastened to said cable wheel, the other end thereof is wrapped over a related guide wheel and connected with said second cable hanger.

11. The top-mounted digital-control tower pumping unit, as recited in claim 7, wherein said balance weight box comprises a main weight box, a multi-level secondary weight block and a plurality of hooks, said secondary weight block is hung on said main weight box via said hooks installed at two sides of said main weight box, said main weight box and said multi-level secondary balance weight block are filled with concrete, sand and steel, a total weight of said multilevel secondary balance weight block is less than 10% of a total weight of said main weight box.

12. The top-mounted digital-control tower pumping unit, as recited in claim 7, further comprising two pull bars respectively installed on said operating platform at two sides of said guide wheel support, two fixed pulleys respectively installed on two upper ends of said pull bars, a pair of pull hooks respectively provided at two sides of said guide wheel fixture, and two steel cables respectively fastened on said pull hooks, wherein the other end of each of said steel cables is fastened on said operating platform after wrapping over a related fixed pulley.

13. The top-mounted digital-control tower pumping unit, as recited in claim 7, wherein said power system is a permanent magnet synchronized braking motor.

14. A top-mounted digital-control tower pumping unit, comprising a tower frame having an operating platform, a power system, a drive system, a control system, a cable wheel, and a guide wheel mechanism, wherein said power system, said drive system, said control system and said cable wheel are installed on said operating platform at a top of said tower frame, said control system is connected with said power system so as to control a reversing position and rotating speed of said power system, said power system is connected with said cable wheel via said drive system;

wherein said guide wheel mechanism comprises a guide wheel support fastened at a side of said operating platform near said cable wheel, one end of a guide bar is installed on said guide wheel support, a rotating shaft passes through a junction of said guide bar and said guide wheel support with one end of said rotating shaft fastened within said guide bar and the other end of said rotating shaft installed within said guide wheel support, a guide wheel fixture is installed at a free end of said guide bar and a guide wheel is installed on said guide wheel fixture;

wherein said cable wheel has first and second set of fastening holes, one end of a balance weight positioning cable is fastened to said first set of fastening holes and one end of a driving cable is fastened to said second set of fastening holes, with said balance weight positioning cable and said driving cable wrapped around said cable wheel in opposite directions to each other a free end of said balance weight positioning cable is connected to a balance weight box by a first cable hanger, and a free end of said driving cable is wrapped over said guide wheel and connected to a polish rod by a second cable hanger;

wherein said drive system comprises a first set of sprocket wheels fastened at an output end of said power system and driving a second set of sprocket wheels, said second set of sprocket wheels installed at an outside middle position of said cable wheel, said cable wheel installed on a cable wheel shaft with two ends of said cable wheel shaft respectively fastened on two shaft seats, said shaft seats fastened on said operating platform.

15. The top-mounted digital-control tower pumping unit, as recited in claim 14, wherein said first set of sprocket wheels consists of two sprocket wheels with a same size, and said second set of sprocket wheels consists of a first and second sprocket wheels with different sizes, wherein a diameter of said second sprocket wheel of said second set is 1.5 times that of said first sprocket wheel of said second set.

16. The top-mounted digital-control tower pumping unit, as recited in claim 15, wherein said top-mounted digital-control tower pumping unit comprises two guide wheel mechanisms installed on said operating platform, two driving cables are respectively wrapped at two ends of said cable wheel, one end of each of said two driving cables is fastened to said cable wheel, the other end thereof is wrapped over a related guide wheel and connected with said second cable hanger.

17. The top-mounted digital-control tower pumping unit, as recited in claim 14, wherein said top-mounted digital-control tower pumping unit comprises two guide wheel mechanisms installed on said operating platform, two driving cables are respectively wrapped at two ends of said cable wheel, one end of each of said two driving cables is fastened to said cable wheel, the other end thereof is wrapped over a related guide wheel and connected with said second cable hanger.

18. The top-mounted digital-control tower pumping unit, as recited in claim 14, wherein said balance weight box comprises a main weight box, a multi-level secondary weight block and a plurality of hooks, said secondary weight block is hung on said main weight box via said hooks installed at two sides of said main weight box, said main weight box and said multi-level secondary balance weight block are filled with concrete, sand and steel, a total weight of said multilevel secondary balance weight block is less than 10% of a total weight of said main weight box.

19. The top-mounted digital-control tower pumping unit, as recited in claim 14, further comprising two pull bars respectively installed on said operating platform at two sides of said guide wheel support, two fixed pulleys respectively installed on two upper ends of said pull bars, a pair of pull hooks respectively provided at two sides of said guide wheel fixture, and two steel cables respectively fastened on said pull hooks, wherein the other end of each of said steel cables is fastened on said operating platform after wrapping over a related fixed pulley.

20. The top-mounted digital-control tower pumping unit, as recited in claim 14, wherein said power system is a permanent magnet synchronized braking motor.

* * * * *